United States Patent [19]

Leonard

[11] Patent Number: 4,588,001

[45] Date of Patent: May 13, 1986

[54] ROTARY FILLING APPARATUS AND METHOD

[75] Inventor: George E. Leonard, Bettendorf, Iowa

[73] Assignee: The Kartridg Pak Co., Davenport, Iowa

[21] Appl. No.: 729,976

[22] Filed: May 1, 1985

Related U.S. Application Data

[63] Continuation-in-part of Ser. No. 507,087, Jun. 23, 1983, Pat. No. 4,532,968.

[51] Int. Cl.[4] ..... B65B 3/04

[52] U.S. Cl. ..... 141/5; 141/94; 141/145; 141/286; 141/DIG. 1

[58] Field of Search ..... 141/1-12, 141/129-191, 198, 250-284, 34, 94-96, 285-310

[56] References Cited

U.S. PATENT DOCUMENTS

| | | | |
|---|---|---|---|
| Re. 23,830 | 5/1954 | Mojonnier | 222/67 |
| 2,172,010 | 9/1939 | Kerr | 141/286 |
| 2,754,082 | 7/1956 | Crandall | 249/63 |
| 2,925,835 | 2/1960 | Mojonnier et al. | 141/83 |
| 2,949,941 | 8/1960 | Mojonnier | 141/141 |
| 3,043,349 | 7/1962 | Bennett | 141/39 |
| 3,316,945 | 5/1967 | Brinkley et al. | 141/140 |
| 3,426,812 | 2/1969 | Brinkley et al. | 141/140 |
| 3,545,170 | 12/1970 | Leonard | 53/88 |
| 3,835,898 | 9/1974 | Leonard | 141/152 |
| 3,857,424 | 12/1974 | Roberts | 141/275 |
| 4,086,741 | 5/1978 | Williams | 53/12 |

*Primary Examiner*—Houston S. Bell, Jr.

*Attorney, Agent, or Firm*—Lockwood, Alex, FitzGibbon & Cummings

[57] ABSTRACT

A rotary filling apparatus and method are provided that are of the type which use gravity to fill liquids into a plurality of containers while they rotate about a rotary filling head. The apparatus includes a level control chamber having a sensor that is disposed from the axial center of the apparatus a distance that is substantially the same as that between this axial center and the nozzle orifice through which the liquids are dispensed into the container, so that the centrifugal force at the sensor is substantially the same as that at the dispensing nozzle when the rotary head is rotated during the filling operation in order to maintain a substantially constant hydraulic head during the operation. The nozzle orifice is included within a nozzle assembly that directs the liquid in a non-vertical direction toward a sidewall of each container being filled.

27 Claims, 11 Drawing Figures

85
87
86
84
31
27
21
29
25
82
28
92
91
26
80
23
52
22
33
48
46
24

85
86
70
27
60
21
29
63
64
28
28
64
B
61
61
26
26
80
62
59
52
80
52
32
36
36
32
22
41
66
66
40
67
57
54
57
56
58
58
50
50
24
53
55
49
47

ROTARY FILLING APPARATUS AND METHOD

This is a continuation-in-part of application Ser. No. 507,087, filed June 23, 1983, now U.S. Pat. No. 4,532,968 the disclosure thereof being incorporated by reference hereinto.

Background and Description of the Invention

This invention generally relates to rotary filling machines, more particularly to an apparatus and method having a dispensing nozzle that directs liquid in a non-vertical direction and toward a sidewall of each container being filled. The invention also controls the fill level, preferably including a sensor that is positioned from the central axis of the rotary head at a distance that is substantially the same as that between this central axis and the outlet of each nozzle assembly. Also preferably included are control assemblies to maintain the desired level within the liquid reservoir and to adjust the fill time while the apparatus is in operation. Other features can include improved explosion-proofing by protecting electronic components within air-purged environments, structural features for facilitating machine clean-up without dismantling same, more consistent liquid flow through the fill nozzles, and features for readily adjusting the height of the rotary head for accommodating various different sizes of containers to be filled.

Rotary fillers have been known for filling containers with a liquid product, including the filling of aerosol containers with liquid product to be packaged with a propellant. Representative of the general type of apparatus that is used for filling liquid components and products is that shown in U.S. Reissue Pat. No. 23,830, wherein a rotating turntable having a plurality of operating stations receives a flow of containers which are filled with liquid while the containers move along the rotating turntable.

In these types of operations, it is typically very important to accurately and closely control the amount of liquid that is fed into each container. Such is important to avoid a shortfall of product filled into the container, to avoid product waste, and to insure that the proper amount of space is available for subsequent filling of the propellant thereinto when desired.

Another difficulty that has been encountered over the years in this regard is the fact that these rotary heads are rotating while the filling mechanism is in operation, which causes the development of forces such as centrifugal forces that affect the metering of liquids while they are passed through the rotary head. Particularly troublesome is the fact that these forces will vary with the speed at which the rotary head is operating, which typically will vary at differing points of the filling operation, for example, when the rotary head must be slowed or stopped in order to accommodate a subsequent operation. Most of these types of variations are not predictable, and it is difficult for an operator to anticipate when a fill level adjustment might be needed.

Difficulties in this regard are compounded when the liquid being filled is of a character such that it foams when it is subjected to turbulence. Once foaming begins, the liquid becomes more difficult to handle and is especially susceptible to foaming over the desired fill level and out of the mouth of the container, thereby resulting in loss of product and product residue on the outside of the container. Previous attempts to solve these difficulties include utilizing complex head designs and operating mechanisms which have nozzles that enter the container being filled to eject the liquid onto the container sides. Such complex structures induce turbulence by smaller filling orifices that are needed to enter the container, and they also have a tendency to drip after shutoff.

Another difficulty with these types of devices is attempting to adjust the fill level while the containers are traversing their path along the rotating turntable. Additionally, in certain instances, expensive and cumbersome explosion-proof cabinetry and components are incorporated as a safety measure, which may be important depending upon the contents being filled into the containers.

Often, with these types of rotary filling machines, particularly that portion of the machinery which adds the liquid component, it is necessary to clean out the various passageways through which the liquid product flows before changing over to a different liquid product. For example, when the liquid being filled is a paint, it is necessary to clean these passageways when changing from one color to another, even though the propellant subsequently added may be exactly the same for any such color. Typically, such a clean up operation involves disassembling at least a portion of the device in order to treat same with solvents and the like.

The present invention responds to these various needs and difficulties by various features which combine to dissipate foaming problems in cooperation with centrifugal forces that are developed in rotary filling devices and to provide a constant hydraulic head that is adjustable while the device is in operation, such including providing a sensor that is located substantially the same distance from the axial center of the rotary turntable as is the opening through which the liquid flows into each container that is being filled. Alignment and trough arrangements are also provided in association with head raising and lowering assembly whereby cleaning of the liquid passageways can be carried out on a generally automatic basis. Suitable cabinetry and fluid flow mechanisms are provided in order to explosion proof the device.

It is accordingly a general object of the present invention to provide an improved rotary filling device.

Another object of this invention is to provide an improved rotar filling device and method that directs liquid being filled into each container in a non-vertical direction and toward a sidewall of the container.

Another object of the present invention is to provide an improved rotary filling device having a substantially constant hydraulic head in order to minimize the effects of variations in centrifugal force on the liquid while the device is being operated.

Another object of this invention is to provide means for adjusting the fill size at any station of a rotary filling device while that device is in operation.

Another object of the present invention is to provide an improved rotary filling device which includes a sharp-edged orifice nozzle design for enhancing fill consistency.

Another object of the present invention is to provide an improved rotary filling device having a pneumatic nozzle actuation feature for more reliable nozzle opening and closing procedures.

Another object of the present invention is to provide an improved rotary filling device having clean-in-place capability that avoids the need to disassemble components in order to clean the liquid flow passageways thereof.

Another object of the present invention is to provide an improved rotary filling device having a simplified and easy-to-operate means for adjusting the gang head height.

Another object of the present invention is to provide an improved rotary filling device that utilizes air purging at air-electrical interfaces in order to eliminate the necessity for explosion-proof electrical wiring and components.

These and other objects and features of the invention will be apparent from the following detailed description, taken in conjunction with the accompanying drawings, wherein.

Figure 1:
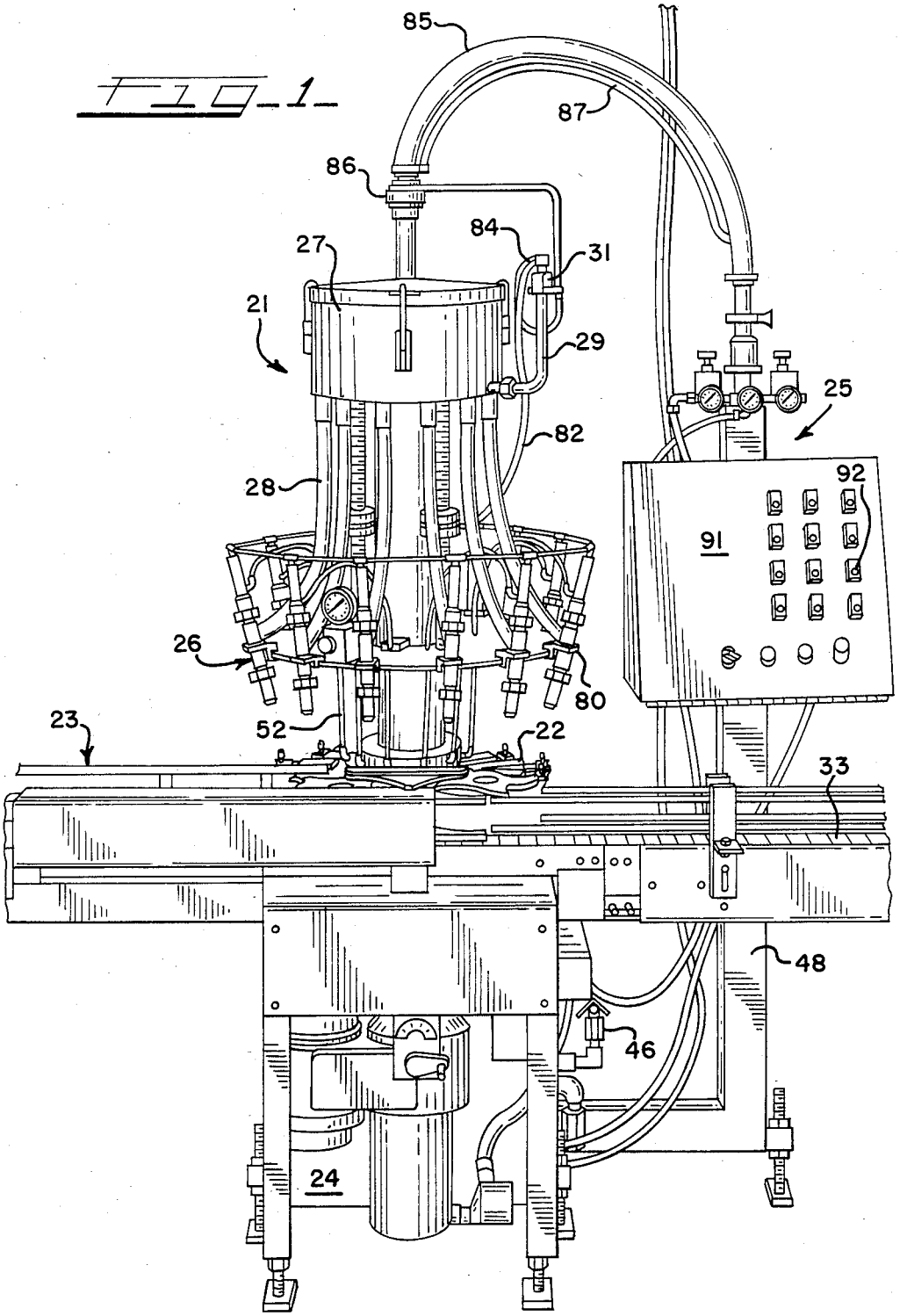
FIG. 1 is a perspective view of the preferred rotary filling device in accordance with this invention.

Referring to FIG. 1, a rotary filling apparatus according to this invention includes a rotary dispensing assembly, generally designated as 21, a rotating turntable 22, a conveyor assembly 23, and a cabinet 24 and a remote control assembly 25, both of which are preferably air-purged.

The rotary dispensing assembly 21 includes a plurality of dispensing heads or nozzle assemblies 26, a reservoir bowl 27, and a plurality of fill conduits 28 therebetween. A level control chamber 29 is in liquid passing communication with the reservoir bowl 27, and a level sensor 31 is mounted thereon. The level sensor 31 is positioned such that the radial distance between the central axis of the rotary dispensing assembly 21 and the sensor 31 is substantially the same as the radial distance by which each dispensing nozzle assembly 26 is spaced from this axis of the rotary dispensing assembly 21.

Conveyor assembly 23 is of a generally known construction for feeding containers 32 (FIG. 2) to and from tne rotary turntable 22. As illustrated in FIG. 3, such includes a worm member 33 or the like for conveying the containers 32 to and from a star wheel 34. A fixed center infeed guide 35 guides the containers 32 being moved by the star wheel 34 onto the rotating turntable 22. A container securement arm assembly, generally designated 36, assists in holding the container 32 in place as it rotates along with the turntable 22 for filling thereof. Thereafter, filled containers **32*a* are returned to the conveyor assembly 23** for transport to a subsequent station (not shown).

Figure 4:
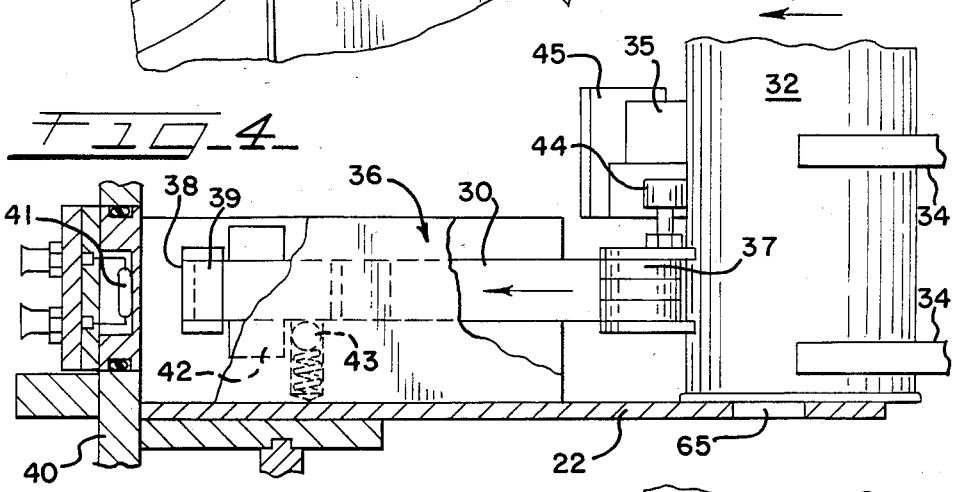
FIG. 4 is a further detailed partial sectional view of the preferred container holding and releasing mechanism in accordance with this invention, showing the device while the container is being grasped and moved toward its filling orientation.
Figure 5:
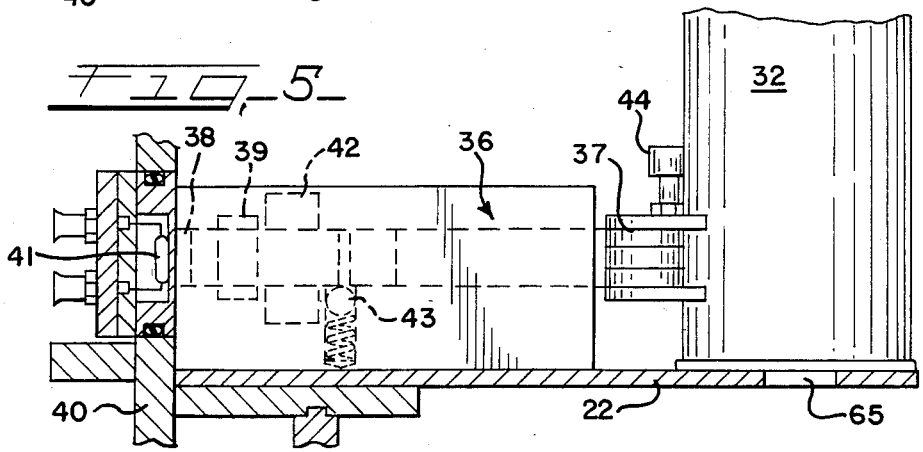
FIG. 5 is a sectional view similar to FIG. 4, illustrating this mechanism after the container has been fully grasped and is at its filling orientation.

With more particular reference to the container arm securement assembly 36, a preferred embodiment thereof is illustrated in FIG. 4 and 5. A rigid arm 30 mounts a slidable magnet assembly 37 to hold container 32 in place on the rotating turntable 22 when assembly 37 is at the orientation illustrated in FIG. 5. The slidable magnet assembly 37 grasps the container 32 when oriented as illustrated in FIG. 4 which is at the location of rotation that is immediately past the center infeed guide 35 and at which the star wheel 34 pushes the container 32 onto the magnet assembly 37. Continued rotation of the star wheel 34 pushes the magnet assembly 37, the rigid arm 30 and an activator magnet 38 to the position shown in FIG. 5.

Before this movement, the activator magnet is spaced from a wall of turret 40 (FIG. 4). If desired, the magnetic field of the activator magnet 38 is collapsed by a shunt 39. After this movement, the activator magnet 38 is closer to a reed switch 41 of known construction, which is enclosed within the air purged cabinet 24 (FIG. 2) on the other side of the wall of turret 40, which is non-magnetic. By virtue of this close proximity between the reed switch 41 and the activator magnet 38, the reed switch is activated in order to signal that the container 32 is correctly positioned under a dispensing nozzle assembly 26 for subsequent filling of the container 32. An appropriate stop arrangement, such as a bumper stop 42 and a detent 43, provide holding forces in opposition to centrifugal forces that are developed while the turntable 22 rotates.

Each container arm securement assembly 36 includes a cam follower 44 for camming engagement with a cam member 45 of the fixed center infeed guide 35. As shown in FIG. 3, the camming engagement assists in separating the slidable magnet 38 from the reed switch 41. This camming engagement ceases before the container arm securement assembly 36 is in alignment for grasping a container 32 to be filled.

Figure 2:
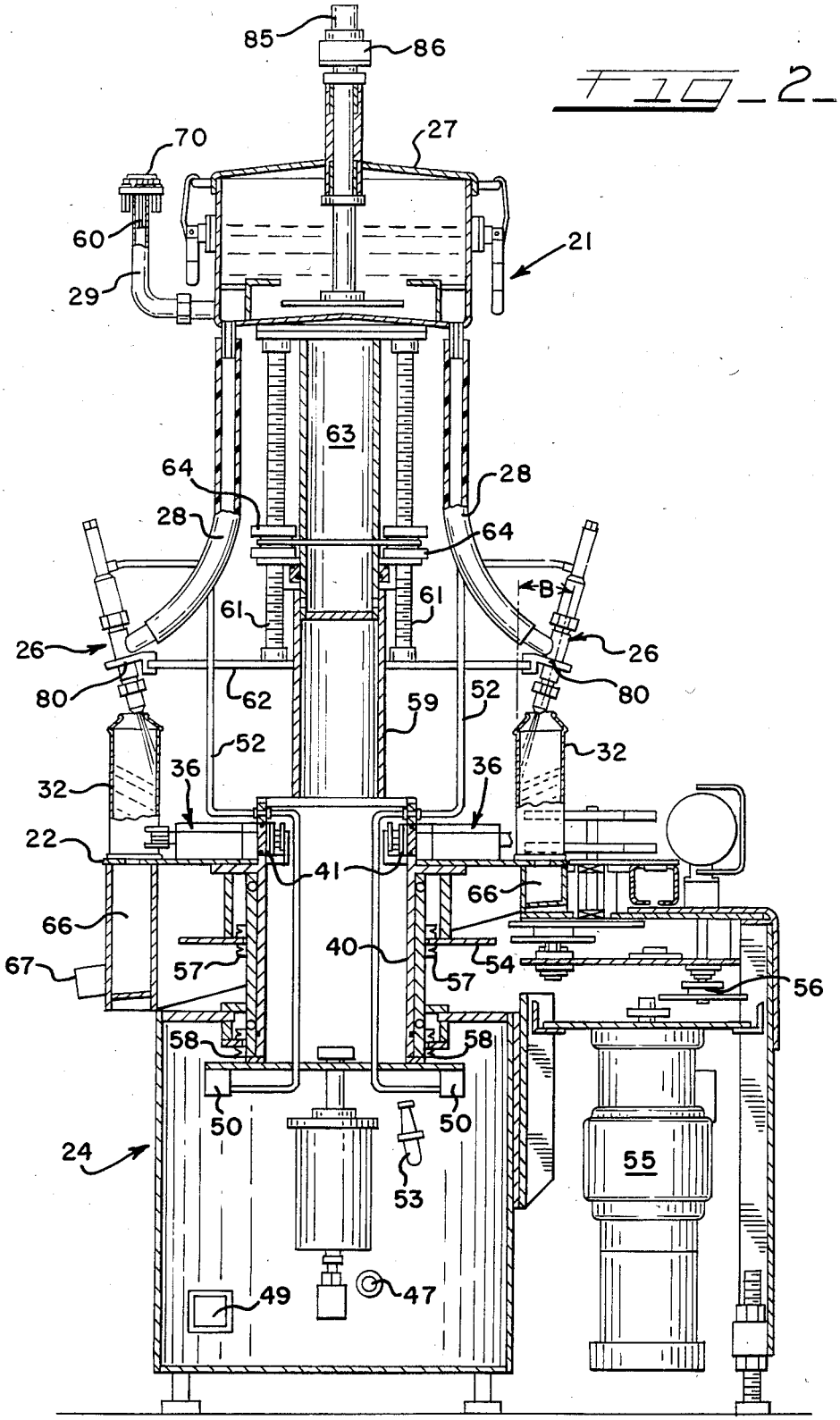
FIG. 2 is a generally vertical sectional view through various components of the rotary turntable and head of the device illustrated in FIG. 1 and of containers being filled thereby.
Figure 3:
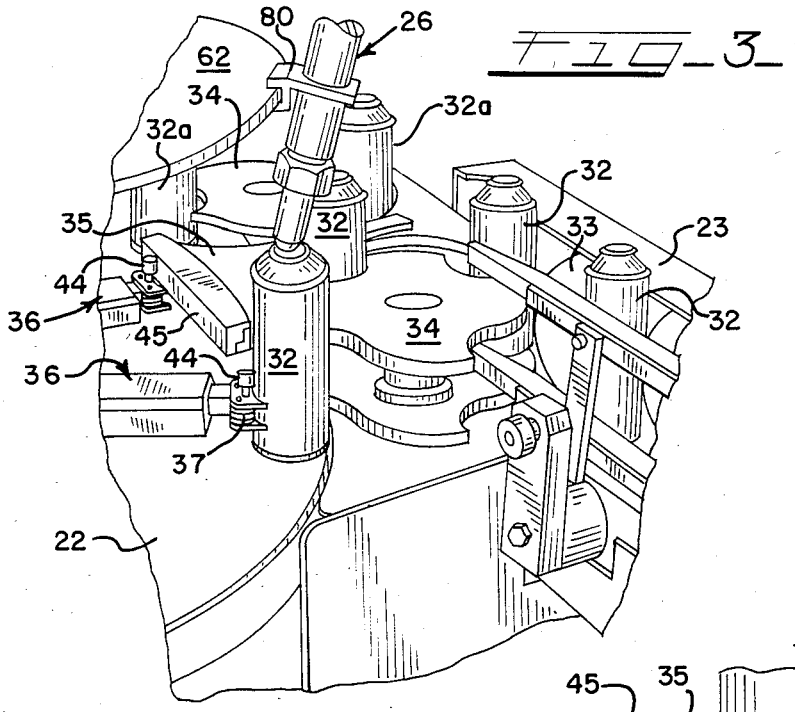
FIG. 3 is a detailed, perspective view of the mechanism by which containers are fed to and away from the rotary turntable of the device.

With more particular reference to the air purging features of the apparatus, an exhaust check valve 46 (FIG. 1) is provided within the cabinet 24 through an appropriate orifice 47 (FIG. 2). Air enters the cabinet 24 from a plurality of locations in order to assure that, while the apparatus is operating, air is the only gas within the cabinet 24, and any possible explosive or otherwise undesirable gases are purged from the cabinet 24, as well as from the cabinetry of the remote control assembly 25. Air seeping into the remote control assembly 25 is drawn out of this cabinet through a conduit 48 (FIG. 1), which enters the air purged cabinet 24 through an opening 49 (FIG. 2). This air flow maintains an air-purged condition within the remote control assembly 25 after initial purging has been carried out.

Similarly, air flows into the cabinet 24 through air lines 52; more particularly the air returning from the dispensing nozzle assembly 26 is exhausted into cabinet 24 at each head control valve 50. More intensive, initial purging is carried out by virtue of a purge air nozzle 53. Typically, pressurized air will enter through the purge nozzle 53 when needed, for example before the unit is first started up, in order to circulate a large flow of relatively rapidly moving air throughout the turret 40, the entire cabinet 24, and the cabinetry for the remote control assembly 25, such flow being exhausted through the orifice 47 and the exhaust valve 46. Preferably, as illustrated, the purge air nozzle 53 is generally directed toward the reed switches 41. It is important to note that there is no dynamic opening between each reed switch 41 and each securement assembly 36, thereby precluding any possibility of having undesirable gase contact the reed switch 41 while the turret 40 remains purged.

Appropriate circuitry is provided, including devices such as rotometers, pressure gauges and pressure switches, in order to thereby monitor the air pressure within the air purged cabinet 24 and the remote control assembly 25. Such circuitry cuts off operating power to the apparatus when such air pressure drops below a predetermined limit.

The turret 40 is structured such that it rotates about a vertical axis that is coaxial with that of the rotary dispensing assembly 21. More particularly, the turret 40 and the rotating turntable 22 are mounted onto a rotating sprocket 54. The turret 40 and rotating turntable 22 are driven by a suitable arrangement, such as one including a motor 55 and a drive assembly 56. Suitable face seals 57, 58 are provided in association with the rotatable mounting of the turret 40.

Rotary dispensing assembly 21 is mounted onto a lift cylinder 59 having threaded rods 61 and a head plate 62 mounted thereto. A lifting ram 63 raises and lowers the head plate 62 along the lift cylinder 59. Positioning of height of the head plate 62 and the dispensing heads 26 mounted thereon can be accomplished by rotating hand limit nuts 64. By this structure, the height of the dispensing nozzle assembly 26 can be readily and rapidly adjusted to accommodate containers 32 having a variety of differing heights.

Figure 6:
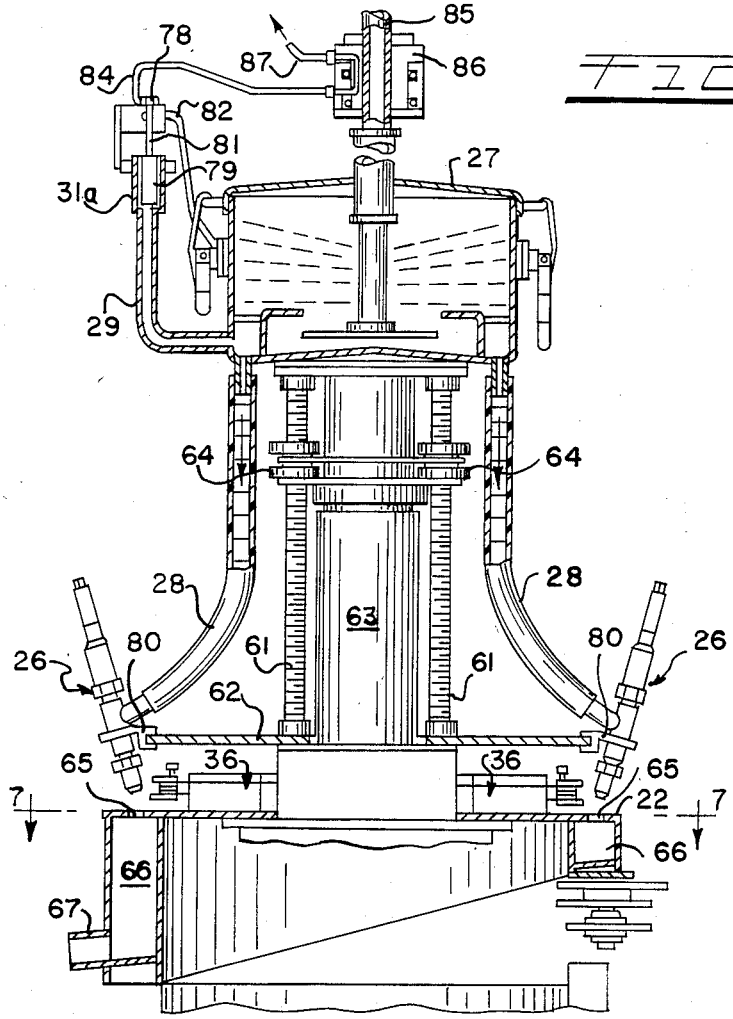
FIG. 6 is a sectional view of the rotary head and associated cabinetry thereunder, showing the device in its cleaning mode, whereby solvents or the like may be passed through the liquid-contacting passageways of the apparatus.
Figure 7:
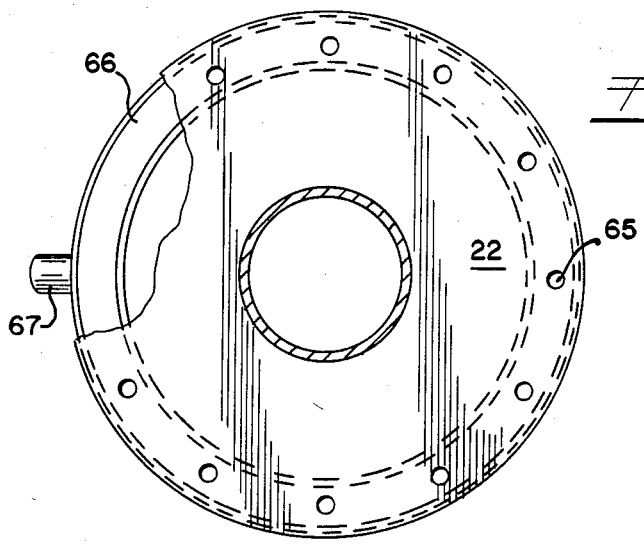
FIG. 7 is a plan view, partially broken away, along the line 7—7 of FIG. 6.

This structure also permits the dispensing heads 26 to be lowered until they substantially contact or are positioned within respective holes 65 in the turntable 22, as generally depicted in FIG. 6. When the dispensing nozzle assemblies 26 are thus positioned, it is possible to readily clean the various passageways of the apparatus through which the liquid being filled into the containers 32 passes in order to thereby readily and simply clean such passageways. This feature is further facilitated by the provision of a peripheral trough 66. Preferably, trough 66 has an inclined bottom surface whereby all of the fluid flowing into the peripheral trough 66 flows through an exit port 67. If desired, the liquid flowing out of the exit port 67 can be recirculated to the reservoir bowl 27 for subsequent recirculation through the system.

Figure 8:
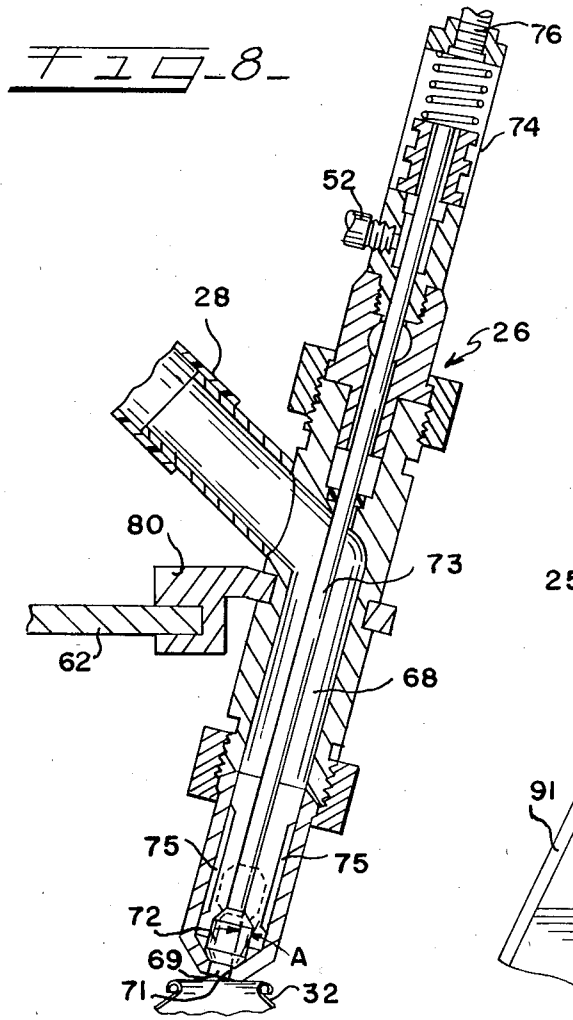
FIG. 8 is a detailed, sectional view of the dispenser valve and nozzle assembly at each station of the rotary device by means of which the liquid product passes into the containers being filled.

More particular details of the preferred dispensing head or nozzle assembly 26 are illustrated in FIG. 8. Liquid to be filled into the containers 32 flows through the fill conduit 28 and through a bore 68 for eventual passage therefrom through a nozzle orifice 69. Preferred nozzle orifice 69 has sharp-edged characteristics in order to impart enhanced laminar flow properties and flow precision to the liquid passing through the nozzle orifice 69. Annular wall 71 of the preferred orifice 69 is not right cylindrical, but has a truncated conical configuration. A typical sharp-edged annular wall 71 has a taper angle A on the order of about 5 to 20 degrees, for exampl approximately 10 degrees. When the annular wall 71 is untapered in this regard, turbulence is generated, and the amount of liquid filled can vary by as much as ±40 grams in 300 grams of liquid that enters the container 32. The sharp-edged annular wall 71 significantly reduces the turbulence to the extent that the quantity of liquid filled into the container during a particular run varies at more on the order of ±0.5 grams in 300 grams of liquid filled into the container 32.

A poppet 72 is mounted onto a slidable shaft 73, and movement of the shaft 73 is effected by a pneumatic cylinder 74. Preferably, the poppet 72 has a very moderate resilience, for example being made of a filled polymer, rather than a metal. Also, the bore 68 may include suitable flutes 75 for enhancing movement of the poppet 72 to and away from the nozzle orifice 69. Preferably, such flutes 75 are located at the nozzle end of the bore 68. The pneumatic cylinder 74 effects extremely positive-acting and reliable opening and closing of the nozzle orifice 69. Pneumatic cylinder 74 preferably includes downwardly directed biasing means in order to reduce the complexity of the valving of the cylinder 74 and to enhance the responsiveness of the pneumatic cylinder 74. Such biasing means can take the form of pressurized air entering through line 76 and/or a spring 77 (illustrated in phantom) or the like.

In an important aspect of this invention, each dispensing head or nozzle assembly 26 is mounted such that it directs liquid therefrom in a non-vertical direction. More particularly, as illustrated in FIG. 2, the liquid being dispensed is directed out of the nozzle orifice 69 toward an inside sidewall of the container 32 in order to control foaming that develops when certain liquid products directly impinge upon a surface. Preferred structure for achieving this aspect of the invention includes an angle bracket 80 that mounts each dispensing nozzle assembly 26 to head plate 62 or the like. This aspect of the invention reduces splashing and foam development because the inside sidewall of the container 32 dissipates the energy of the flowing liquid by frictionally acting on the flowing liquid at a shallow or acute angle that is generally designated as filling angle B in FIG. 2. The magnitude of the filling angle B will vary somewhat depending upon the size of the containers 32 and the type of liquid being filled. For example, an optimal filling angle B for a container of the size illustrated in the drawings is on the order of about 15°. A container having a wider mouth and a larger diameter would be better served with a larger angle. Adjustable angle brackets can be provided to facilitate the adjustment of the filling angle as needed.

Filling angle B also reduces splashing and foaming by directing the effects of product shutoff onto the inside sidewall of the container 32 rather than into a pool of liquid as in prior systems, which can create a splash as the liquid pool quickly closes in the void that had been created by the stream of liquid. By having product shutoff occur on the sidewall, the energy that is developed upon shutoff is dissipated to minimize splashing. Furthermore, as illustrated in FIG. 2, centrifugal forces, which are imparted to liquid filled into each container by virtue of rotation of the turntable 22, slope the surface of the liquid in each container. In the preferred arrangement shown in FIG. 2, this product surface slope assists in reducing the height of the liquid in the container along that portion of the container sidewall which receives the stream of liquid from the dispensing nozzle assembly 26. This latter feature is achieved, as illustrated, by mounting each nozzle assembly such that the stream of liquid therefrom is directed generally toward the central axis of the rotary dispensing assembly 21, more particularly such that the stream has a horizontal directional component that is toward the central axis and generally opposite to the direction of the centrifugal force acting on the liquid within each container 32.

With more particular reference to the level control chamber 29 and to the level sensor 31 thereof, the level sensor 31 provides pneumatic sensing of the level of liquid within the level control chamber 29 in order to thereby signal appropriate circuitry to control the volume of liquid entering the bowl 27. Level sensor 31 may take the form of a cone jet sensor (illustrated in FIGS. 2 and 11) of generally known construction, preferably in association with a tube 60 and a disc 70. The cone jet sensor aspirates and pressurizes in response to flow through an annular orifice.

An alternative structure of the level sensor is illustrated in FIG. 6. This level sensor 31*a* includes a sensor poppet 78 on top of a float 79 mounted onto an axial rod 81. Liquid within the reservoir bowl 27 is allowed to flow into the level control chamber 29 and to the level sensor 31*a*. When liquid within the level sensor 31*a* rises above a predetermined height, the poppet 78 is raised, thereby permitting low pressure air from inlet restrictor 82 to pass to exhaust by flowing upwardly along the length of the float rod 81. A pneumatic signal proportional to the liquid level in bowl 27 is thus sensed to line 84.

Figure 9:
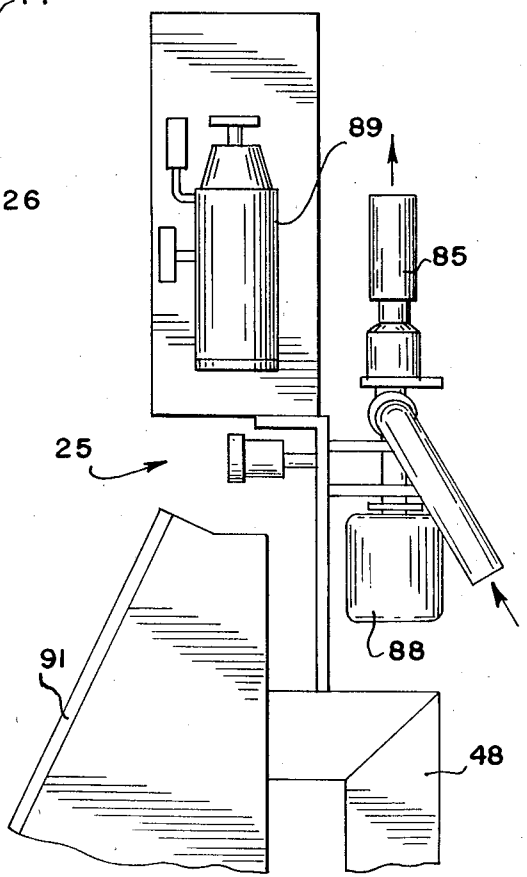
FIG. 9 is an elevational view of a portion of the preferred product flow control mechanism.

With more particular reference to the mechanism for controlling the level of liquid within the reservoir bowl 27, such liquid flows thereinto through a stationary product tube 85 that is mounted within a rotary union 86. The air signal passing from the outlet 84 of the level sensor 31, 31*a* is transmitted through tubing 87 which runs to the control assembly 25 (FIGS. 1 and 9). A liquid product control valve 88 controls the actual flow of product through the stationary product tube 85. This liquid product control valve 88 is regulated by an automatic valve controller 89, such as Nullmatic controller (Moore Products Co.). A control panel 91 includes a plurality of potentiometers 92 for accurate adjustment of the fill level. The fill level is the amount of liquid product that passes through the nozzle orifice 69 of each respective dispensing head or nozzle assembly 26. Suitable circuitry is provided within the control panel 91 for precisely adjusting the time during which each respective pneumatic cylinder 74 (FIG. 8) raises each respective poppet 72 away from its respective nozzle orifice 69, even while the apparatus is in operation.

Figure 11:
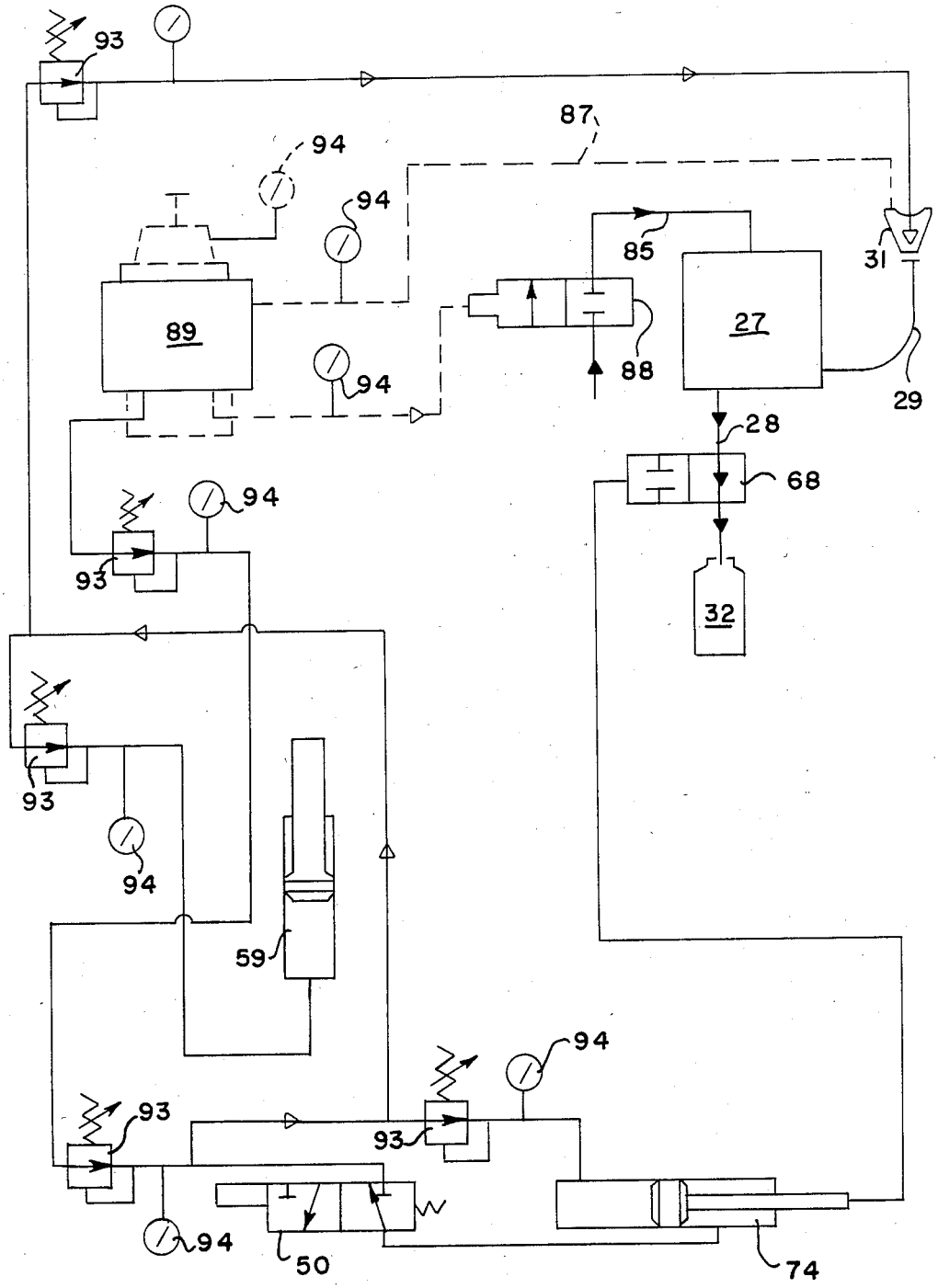
FIG. 11 is a schematic view of the principal circuitry used in this device.

The pneumatic circuitry of the apparatus is schematically illustrated in FIG. 11, from which various actuation and control interrelationships are illustrated. It can be seen that the automatic valve controller 89 receives a signal, typically involving a change in air pressure, from the level sensor 31, which itself is activated by liquid product passing thereinto from the reservoir bowl 27 in response to the height of liquid therewithin. It will be appreciated that, in accordance with an important aspect of this invention, this liquid product level that triggers the level sensor 31 is generated in part by centrifugal forces on the liquid product while the reservoir bowl 27 and the level control chamber 29 are rotating.

In response to this signal from the level sensor 31, the automatic valve controller 89 imparts a signal, such as a change in air pressure, to the liquid product control valve 88 to permit a controlled amount of liquid product to pass through the stationary tubing 85 and into the reservoir bowl 27 in order to maintain the liquid height that will develop the gravitational forces needed to pass the desired amount of liquid product through the fill conduit 28 and the bore 68 into the container 32 that is being filled. This passage into the container 32 is controlled by the pneumatic cylinder 74, which is in turn activated by the control valve 50. Appropriate sensor regulators 93 and gauges 94 are provided to monitor this circuitry.

Figure 10:
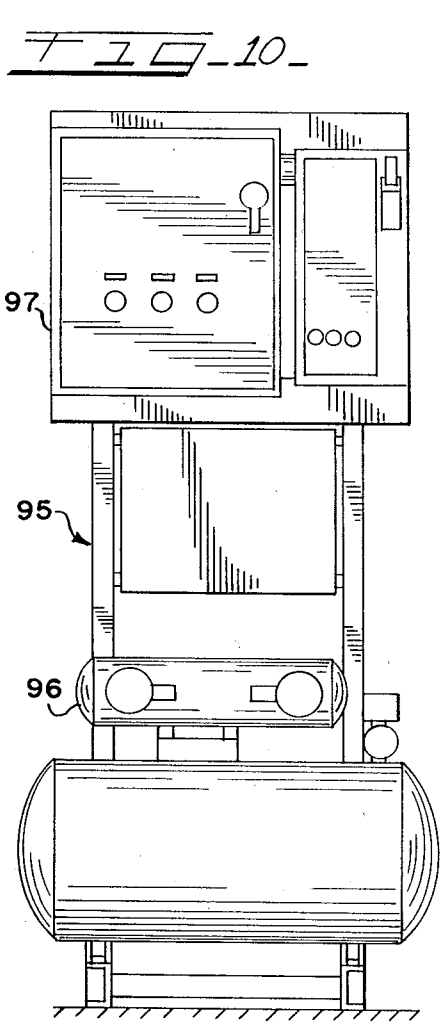
FIG. 10 is an elevational view of a remotely located control enclosure for the device according to this invention.

FIG. 10 illustrates a remote support assembly 95 that is located within a non-hazardous area. Assembly 95 includes an air compressor, which is capable of providing compressed air that is of instrument quality, together with suitable controls 97 for the compressor, its motor and starter.

It will be understood that the embodiments of the present invention which have been described are merely illustrative of a few of the applications of the principles of the present invention. Numerous modifications may be made by those skilled in the art without departing from the true spirit and scope of the invention.

What is claimed is:

1. A rotary filling apparatus of the type which uses gravity for filling a liquid into a series of containers, the apparatus comprising:

a rotary dispensing assembly rotatably mounted along a generally vertical central axis, said rotary dispensing assembly including a liquid reservoir bowl and a dispensing nozzle means through which the liquid is dispensed, said dispensing nozzle means having a nozzle outlet orifice which is spaced a predetermined distance from said central axis, and said dispensing nozzle means directs liquid from said nozzle outlet orifice in a non-vertical direction and toward a sidewall of each container;

liquid level control means associated with said liquid reservoir bowl, said liquid level control means monitoring and controlling the amount of liquid that is dispensed through said nozzle outlet orifice;

a turntable including means for positioning each container to be filled at a location below and closely spaced from said nozzle outlet orifice; and means for controlling the opening and closing of said dispensing nozzle means when each container to be filled is positioned thereunder.

2. The rotary filling apparatus of claim 1, wherein said nozzle outlet orifice is substantially external of the container being filled therethrough.

3. The rotary filling apparatus of claim 1, wherein said dispensing nozzle means includes angle bracket means for mounting the nozzle means at a filling angle that is defined by the flow of liquid through the nozzle outlet orifice and the container sidewall toward which the flow of liquid is directed, said filling angle being an acute angle.

4. The rotary filling apparatus of claim 1, wherein said dispensing nozzle means directs liquid from said nozzle outlet orifice generally toward said vertical central axis of the rotary dispensing assembly.

5. The rotary filling apparatus of claim 1, wherein said turntable includes securement arm means for grasping the container supported on the turntable.

6. The rotary filling apparatus of claim 5, wherein said securement arm means includes a slidable magnet assembly and a magnetically activated switch.

7. The rotary filling apparatus of claim 1, further including a turret centrally located with respect to the turntable and securement arm means having a slidable assembly mounted exteriorly of said turret and a switch mounted interiorly of said turret.

8. The rotary filling apparatus of claim 1, further including a turret associated with said turntable and securement arm means having a magnetic assembly mounted exteriorly of said turret and a reed switch mounted interiorly of said turret.

9. The rotary filling apparatus of claim 1, further including a fixed infeed guide having a cam surface and securement arm means on said turntable, said securement arm means including a cam follower that engages said cam surface at a filled container exit location of the turntable.

10. The rotary filling apparatus of claim 1, wherein all electrical interfaces of the apparatus are included within an enclosed chamber that is under a positive pressure of a non-explosive gas.

11. The rotary filling apparatus of claim 1, further including a turret and associated cabinetry, said turret and cabinetry being generally closed except for gas purging orifices.

12. The rotary filling apparatus of claim 1, further including a turret, and wherein said rotary dispensing assembly, said turntable and said turret are coaxial.

13. The rotary filling apparatus of claim 1, wherein said rotary dispensing assembly is mounted onto a gang lifting assembly.

14. The rotary filling apparatus of claim 1, wherein said turntable includes a hole therethrough in general alignment with the dispensing nozzle means and a liquid receiving trough thereunder, and wherein said rotary dispensing assembly includes means for lowering same and for movement of the dispensing nozzle means to said hole.

15. The rotary filling apparatus of claim 1, wherein said nozzle outlet orifice is sharp-edged.

16. The rotary filling apparatus of claim 1, wherein said dispensing nozzle outlet orifice has an annular wall that has a truncated conical configuration.

17. The rotary filling apparatus of claim 1, wherein said dispensing nozzle outlet orifice includes a slidably mounted poppet overlying said outlet orifice, and an actuating member for moving said poppet to open and close said orifice.

18. The rotary filling apparatus of claim 17, wherein said actuating member is a pneumatic valve.

19. The rotary filling apparatus of claim 1, wherein said level control means includes a liquid level sensor and a level control chamber that is a cone jet sensor.

20. The rotary filling apparatus of claim 1, wherein said level control means includes a liquid level sensor and a level control chamber that includes a sensor poppet that is responsive the level of liquid within the level control chamber.

21. The rotary filling apparatus of claim 1, further including an automatic valve controller in association with the level control means.

22. The rotary filling apparatus of claim 1, wherein said level control means includes a liquid level sensor that is spaced from said central axis by a distance that is substantially the same as said predetermined distance such that centrifugal force at the liquid level sensor is substantially the same as that at said nozzle outlet orifice when the rotary dispensing assembly is rotated during filling in order to maintain a substantially constant hydraulic head during operation.

23. A method of the type which uses gravity for filling a liquid into a plurality of containers while they rotate about a rotary filling head, comprising:

positioning a container to be filled onto a turntable having a generally vertical central axis;

rotating the turntable about its axis to bring the container into alignment with a dispensing nozzle;

flowing a predetermined amount of liquid from a reservoir and through the dispensing nozzle outlet orifice spaced a predetermined distance from the central axis while the dispensing nozzle outlet orifice and the reservoir are rotating about the generally vertical central axis, said flowing step including directing liquid from said nozzle outlet orifice in a non-vertical direction and toward a sidewall of each container;

sensing the level of liquid within the rotating reservoir and adjusting the level of liquid within the rotating reservoir in response to the sensing step; and said flowing step is responsive to the sensing and adjusting steps in order to control the amount of liquid that is dispensed through said nozzle outlet orifice.

24. The filling method of claim 23, wherein said flowing step includes locating the dispensing nozzle outlet orifice substantially externally of the container.

25. The filling method of claim 23, wherein said liquid flowing step includes dispensing the liquid at a filling angle that is defined by the flow of liquid through the nozzle outlet orifice and the container sidewall toward which the flow of liquid is directed, said filling angle being an acute angle.

26. The filling method of claim 23, wherein said liquid flowing step includes directing liquid from said nozzle outlet orifice generally toward said vertical central axis.

27. The filling method of claim 23, wherein said sensing step takes place at a location that is spaced from the generally vertical axis by a distance that is substantially the same as the predetermined distance such that centrifugal force at the sensing location is substantially the same as that at said nozzle outlet orifice during rotation thereof, whereby a substantially constant hydraulic head is maintained within the rotating reservoir.

* * * * *